US007445560B2

(12) United States Patent
Greger et al.

(10) Patent No.: US 7,445,560 B2
(45) Date of Patent: Nov. 4, 2008

(54) OPEN TOP SWING

(75) Inventors: Jeff G. Greger, Lititz, PA (US); Matthew J. Ransil, Richland, PA (US)

(73) Assignee: Graco Children's Products Inc., Exton, PA (US)

( * ) Notice: Subject to any disclaimer, the term of this patent is extended or adjusted under 35 U.S.C. 154(b) by 0 days.

(21) Appl. No.: 11/413,934

(22) Filed: Apr. 28, 2006

(65) Prior Publication Data

US 2006/0194639 A1 Aug. 31, 2006

Related U.S. Application Data

(63) Continuation of application No. 10/804,226, filed on Mar. 19, 2004, now abandoned.

(60) Provisional application No. 60/457,307, filed on Mar. 26, 2003.

(51) Int. Cl.
*A63G 9/16* (2006.01)

(52) U.S. Cl. ..... 472/119; 297/273

(58) Field of Classification Search ..... 472/118–125; 297/273, 280, 281, 277, 310, 364, 365; 5/101, 5/108–109

See application file for complete search history.

(56) References Cited

U.S. PATENT DOCUMENTS

| | | | |
|---|---|---|---|
| 242,601 | A | 6/1881 | Clement |
| 266,492 | A | 10/1882 | Mason |
| 465,275 | A | 12/1891 | Kennedy et al. |
| 743,546 | A | 11/1903 | Nix |
| 3,256,016 | A | 6/1966 | Berlin |
| 3,990,667 | A | 11/1976 | Tomalinas |
| 4,150,820 | A | 4/1979 | Bochmann |
| 4,324,432 | A | 4/1982 | Eldon, III et al. |
| 4,697,845 | A | 10/1987 | Kamman |
| 4,807,872 | A | 2/1989 | Spilman et al. |
| 4,884,314 | A | 12/1989 | Miner et al. |
| 5,322,343 | A | 6/1994 | Parker et al. |
| 5,803,817 | A | 9/1998 | Stern |
| 6,027,409 | A | 2/2000 | Favorito et al. |
| 6,059,667 | A | 5/2000 | Pinch |

(Continued)

FOREIGN PATENT DOCUMENTS

| | | |
|---|---|---|
| EP | 1 078 587 | 2/2001 |
| EP | 1 360 917 | 11/2003 |

OTHER PUBLICATIONS

Official Search Report issued in corresponding British application No. 0406794.8.

(Continued)

*Primary Examiner*—Kien Nguyen
(74) *Attorney, Agent, or Firm*—Lempia Braidwood LLC

(57) ABSTRACT

An open top child swing includes a frame, first and second hanger arms rotatably coupled to the frame, and a seat coupled to the first and second hanger arms. The frame can include a first hanger mount configured to removably receive the first hanger arm and a second hanger mount configured to removably receive the second hanger arm so that the seat can be removed from the frame. The frame also can include first and second legs, first and second housings coupled to the first and second legs, respectively, and a battery back removably mounted to one of the first and second housings.

9 Claims, 9 Drawing Sheets

U.S. PATENT DOCUMENTS

| | | | | |
|---|---|---|---|---|
| 6,277,028 | B1 | 8/2001 | Liu | |
| 6,386,986 | B1 | 5/2002 | Sonner et al. | |
| 6,402,233 | B1 | 6/2002 | Tseng | |
| 6,511,123 | B1 * | 1/2003 | Sitarski et al. | 297/130 |
| 6,582,018 | B2 | 6/2003 | Tseng | |
| 6,645,080 | B1 | 11/2003 | Greger | |
| 6,648,768 | B1 | 11/2003 | Tseng | |
| 2004/0198512 | A1 | 10/2004 | Ransil et al. | |

OTHER PUBLICATIONS

Official Search Report issued in corresponding French application No. 0403149.

Clarion 6 Speed Gentle Choice Open Top Swing, Graco, 2 pp., publication date unknown.

6 Speed Open Top Swing in Specator, Graco, 2 pp., publication date unknown.

Open Top Swing—Jack & Jill, Fisher-Price, 1 pp., publication date unknown.

Peaceful Time Open Top Swing, Product # B8046, Fisher-Price, 1 pp, publication date unknown.

Open Top Take-Along Swing, Product # C4636, Fisher-Price, 1 pp., publication date unknown.

Photographs of Storchenmule "Maxi" Product, 4 pages, dates unknown.

* cited by examiner

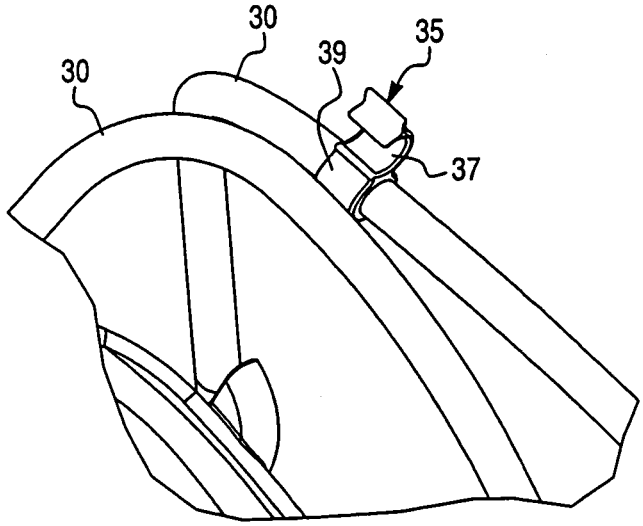
Fig. 2A
Fig. 2
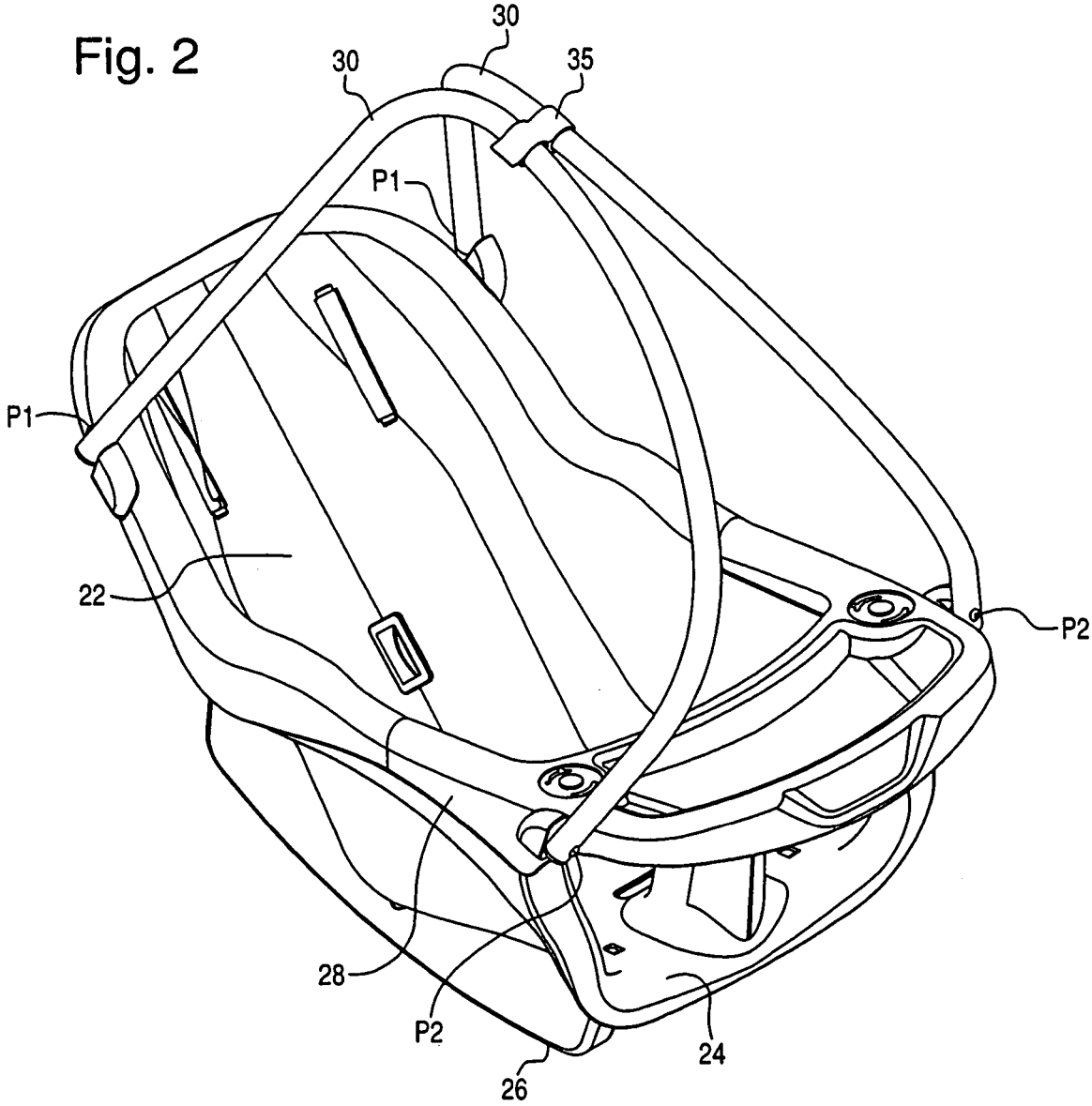

OPEN TOP SWING

CROSS-REFERENCE TO RELATED PATENT APPLICATIONS

This application is a continuation application claiming the priority benefit of U.S. patent application Ser. No. 10/804,226, filed Mar. 19, 2004, now abandoned and which claims the priority benefit of U.S. provisional application Ser. No. 60/457,307, filed Mar. 26, 2003, which is incorporated by reference herein in its entirety.

FIELD OF THE INVENTION

The invention relates to a swing. More specifically, the invention relates to an open top child swing with a detachable seat.

BACKGROUND OF THE INVENTION

Various types of child swings are known in the art. Typically, open top child swings include a support frame, hanger arms pivotally attached to the support frame, and a seat attached to the hanger arms. Electrically powered drive mechanisms are utilized to supply energy to the swing to move the swing seat in a reciprocal motion back and forth.

Most commercially available swings are cumbersome and too large to be easily moved from room to room. To avoid leaving a child unattended in the swing, a caregiver must either remain in one location while using the swing or must remove the child from the swing and carry the child as the caregiver moves from one room to another.

Additionally, most swings employ a battery pack to power the drive mechanism. The battery pack may be stored in a swing housing, which is located near an upper portion of the swing. The battery pack, however, can be difficult to remove. For example, a caregiver may be required to use tools or to partially disassemble the swing housing to access and remove the battery pack for recharging or replacement.

Thus, there is a need for an open top child swing that enables the child to be easily transported, that includes a battery pack that can be removed without difficulty, and that has a storage space for small items.

SUMMARY OF THE INVENTION

An aspect of the present invention relates to an open top child swing that includes a frame, first and second hanger arms rotatably coupled to the frame, and a seat coupled to the first and second hanger arms. The frame has a first hanger mount configured to removably receive the first hanger arm and a second hanger mount configured to removably receive the second hanger arm so that the seat can be removed from the frame.

Another aspect of the present invention relates to an open top child swing that includes a frame and a seat configured to be suspended from the frame. The frame includes first and second legs, first and second housings coupled to the first and second legs, respectively, and a battery back removably mounted to one of the first and second housings.

A further aspect of the invention relates to a child swing that comprises frame components and a seat assembly. The frame components include first and second legs, first and second housings coupled to the first and second legs, respectively, and first and second hanger mounts coupled to the first and second housings, respectively. The seat assembly includes first and second hanger arms removably coupled to the first and second hanger mounts, respectively, and a seat coupled to the first and second hanger arms. When the seat assembly is removed from the first and second hanger mounts, an area between the first frame components and the second frame components is open.

It is to be understood that both the foregoing general description and the following detailed description are exemplary and explanatory only and are not restrictive of the invention as claimed.

BRIEF DESCRIPTION OF THE DRAWINGS

The accompanying drawings, which are incorporated in and constitute a part of this specification, illustrate several embodiments of the invention and, together with the description, serve to explain the principles of the invention.

FIG. 2 is a perspective view of a seat and hanger arms of the swing of FIG. 1 showing the hanger arms in a carrying position.

FIG. 2A is a perspective detail view of portions of the hanger arms and a clasp of the swing of FIG. 1.

DETAILED DESCRIPTION

Reference will now be made in detail to embodiments of the invention, examples of which are illustrated in the accompanying drawings. An effort has been made to use the same reference numbers throughout the drawings to refer to the same or like parts.

Figure 1:
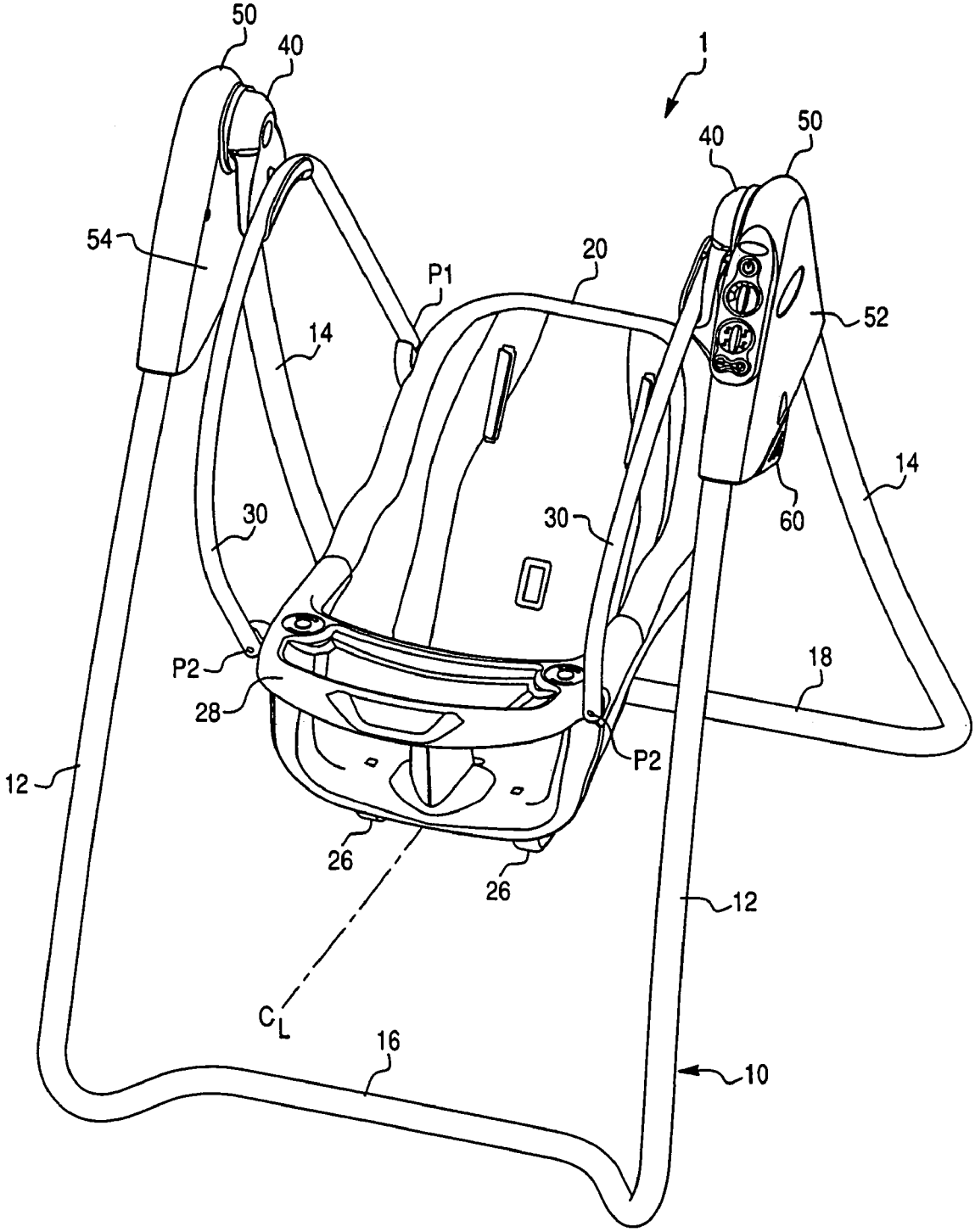
FIG. 1 is a perspective view of an embodiment of a swing according to the invention.
Figure 3:
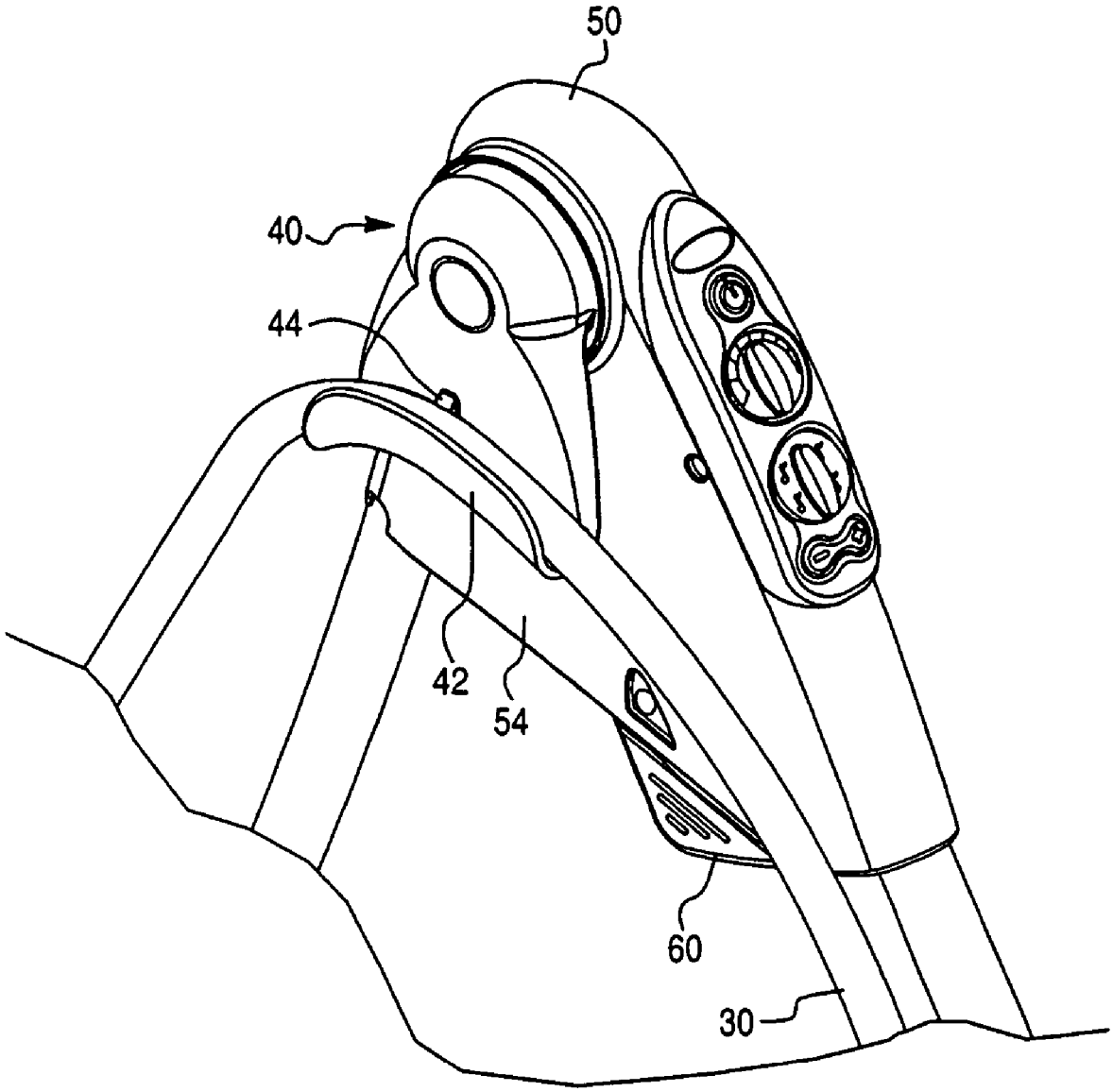
FIG. 3 is a perspective detail view of a hanger arm received in a hanger mount.

FIG. 1 illustrates a swing 1 according to an embodiment of the present invention. The swing can comprise frame components, such as first and second legs, first and second housings coupled to the respective legs, and first and second hanger mounts coupled to the respective housings. The swing also can comprise a seat assembly that includes a seat and first and second hanger arms removably coupled to the respective hanger mounts. The seat assembly can be removed from the frame and, in particular, from the hanger mounts, without the use of tools or disassembly of the frame. When the seat assembly is removed from the frame, an area between the first and second frame components is open and unobstructed. For example, the area between the innermost frame component on a first side of the swing and the innermost frame component on a second side of the swing is open and unobstructed.

In one embodiment, the swing 1 includes a frame 10, a pair of hanger arms 30 rotatably coupled to the frame 10, and a seat 20 coupled to the hanger arms 30. The frame 10 supports the hanger arms 30 so that the seat 20 can be suspended from the frame 10.

The frame 10 generally includes first and second front legs 12, first and second rear legs 14, housings 50 to which the front and rear legs 12, 14 are coupled, a front cross member 16 extending between the front legs 12, and a rear cross member 18 extending between the rear legs 14. In other embodiments, the frame can include first and second front legs only or first and second rear legs only. As shown in FIG. 1, the area between uppermost portions of the frame 10 is open so that a child can easily be installed in or removed from the seat 20 by a user. Additionally, the frame 10 optionally can be configured to fold. For example, the front legs 12 and the rear legs 14 can be assembled so as to pivot relative to each other within the respective housings 50, such as disclosed in U.S. Pat. No. 6,645,080, issued Nov. 11, 2003, and U.S. application Ser. No. 10/702,514, filed Nov. 7, 2003, both of which are incorporated by reference herein in their entirety. A user can fold the frame 10, for example, by moving the rear legs 14 toward the front legs 12.

Figure 5:
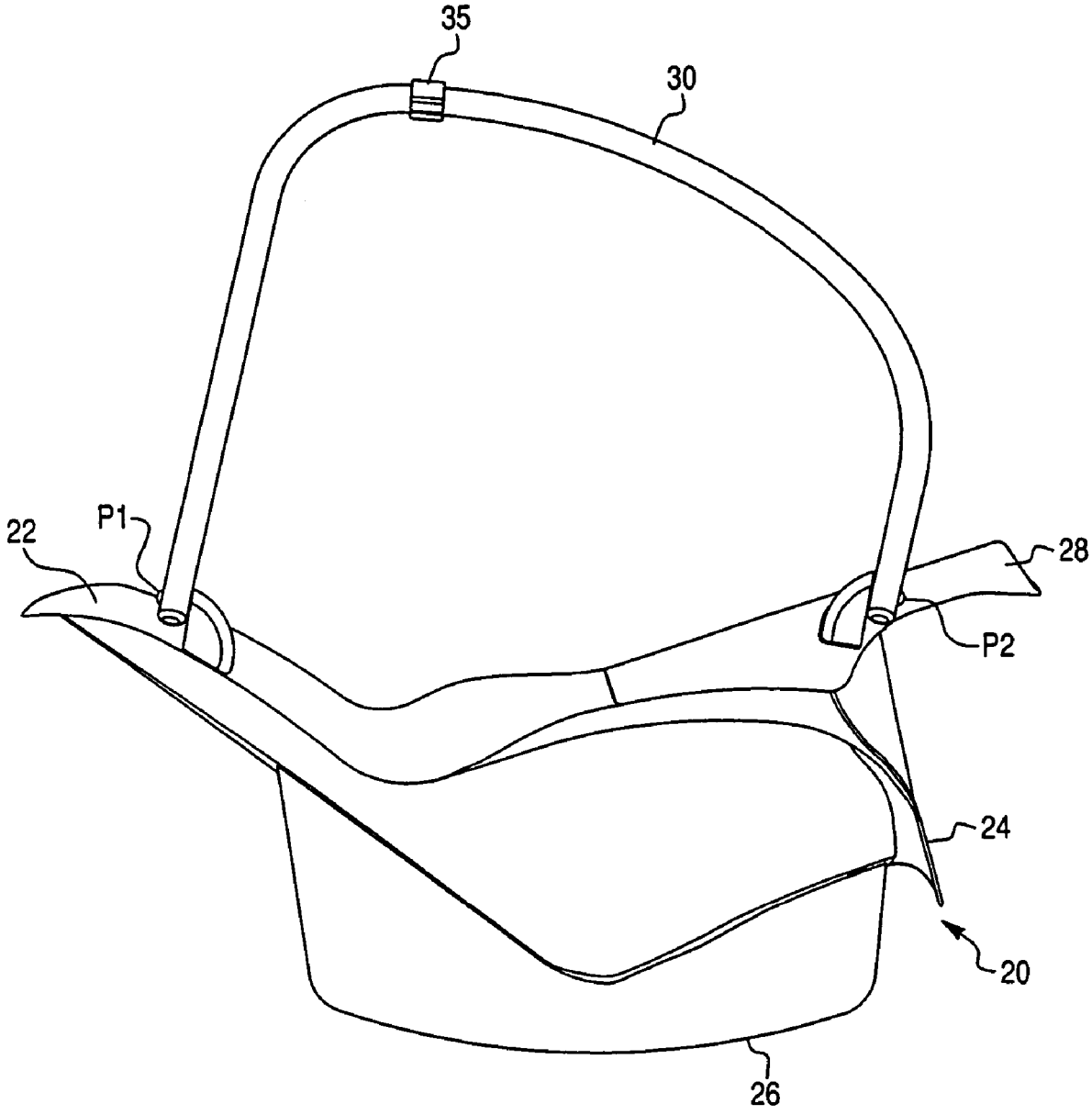
FIG. 5 is a side elevational view of the seat and hanger arms of the swing in the carrying position.
Figure 7:
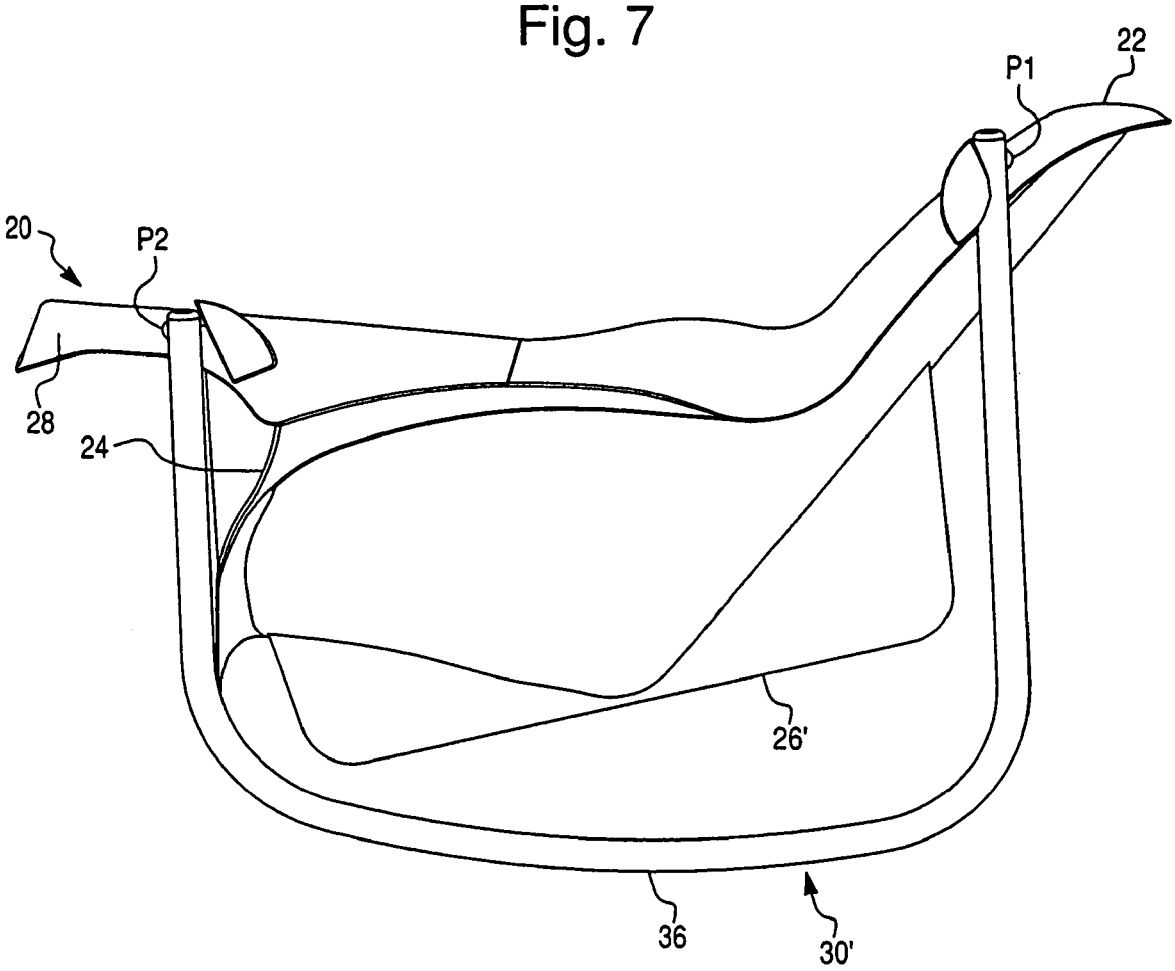
FIG. 7 is a side elevational view of a seat and hanger arms according to an alternative embodiment of the swing showing the hanger arms in a support position.

As mentioned above, the seat 20 is suspended from the frame 10 by the hanger arms 30 and is configured to receive the child. As shown in FIG. 2, the seat 20 includes a seat back (or backrest) 22 and a seat bottom 24 so that the child can be comfortably positioned in the seat 20. An underside of the seat 20 can be configured to support the seat 20 when the seat 20 is detached from the frame 10 and placed on a support surface, such as a floor or table. The underside can be curved to enable the seat 20 to rock when placed on the support surface. For example, as best shown in FIGS. 1 and 5, the underside can include a pair of curved rockers 26. Each curved rocker 26 can extend along an underside of the seat back 22 and the seat bottom 24, and the rockers 26 can be integrally molded with the seat 20 or can be coupled to the seat 20 by conventional fasteners. Alternatively, as shown in FIG. 7, the underside 26' can be substantially flat so that the seat 20 remains stationary when placed on the support surface.

In electric swings, the swing 1 can include a motor mechanism and a power supply for supplying power to the motor mechanism to drive swinging motion of the seat 20. The motor mechanism and the power supply can be disposed within one of the housings 50. The power supply may be, for example, a battery pack 60, as will be described in more detail in connection with FIGS. 8 and 9.

Figure 4:
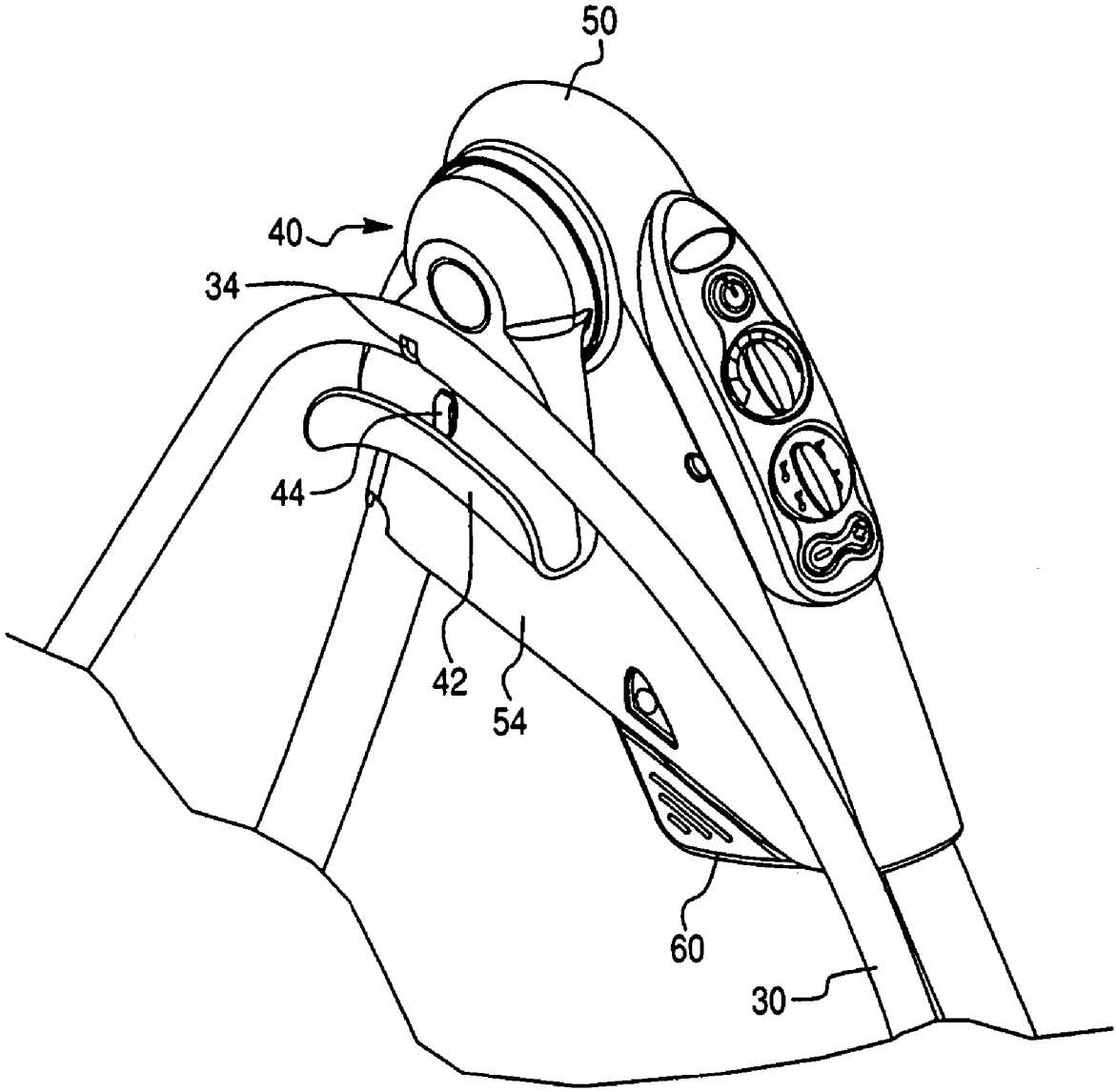
FIG. 4 is a perspective detail view of the hanger arm of FIG. 3 removed from the hanger mount.

The frame 10 can also include a pair of hanger mounts 40. The hanger mounts 40 are rotatably coupled to the housings 50 and are configured to engage the respective hanger arms 30 so that the seat 20 can be suspended from the frame 10. As shown in FIG. 4, each hanger mount 40 can include a hook 42 configured to receive a portion of the respective hanger arm 30. The hook 42 can be shaped to guide the hanger arm 30 into proper alignment on the hanger mount 40. For example, the hook 42 may be substantially U-shaped to define a channel to receive the hanger arm 30. In this manner, the hanger arm 30 can be properly seated in the hanger mount 40. Additionally, the hanger mounts 40 are configured to impart swinging motion to the hanger arms 30 and the seat 20.

To ensure that the hanger arms 30 remain seated in the hanger mounts 40, particularly when the seat 20 is in motion, each hanger mount 40 can include a rib (or ribs) 44 disposed on an inner portion of the hook 42 of the hanger mount 40. One such rib 44 is shown in FIG. 4. The rib 44 may be, for example, integrally molded with the hanger mount 40. Similarly, each hanger arm 30 can include a corresponding recess (or recesses) 34 configured to slidably engage the respective rib 44. One such recess 34 is shown in FIG. 4. In the embodiment shown in FIG. 4, the hanger mount 40 has a pair of ribs 44 on opposing interior faces of hook 42 (one rib 44 being visible), and the hanger arm 30 has a pair of corresponding recesses 34 on opposite sides of the hanger arm 30 (one recess 34 being visible). When the ribs 44 and the recesses 34 are engaged, the hanger arm 30 is retained in the hanger mount 40. In alternative embodiments, the hanger mount 40 and the hanger arm 30 can include one, or more than two, ribs and corresponding recesses, respectively.

The user can install the respective hanger arms 30 in the respective hanger mounts 40 by positioning the hanger arms 30 above the hanger mounts 40 so that the recesses 34 align with the ribs 44. The hanger arms 30 can then be lowered so that the recesses 34 and the ribs 44 slidably engage. In this manner, the hanger arms 30 can be secured to the hanger mounts 40 so that the hanger arms 30 are prevented from inadvertently slipping off of the hanger mounts 40. To disengage the hanger arms 30 from the hanger mounts 40, the user simply lifts the hanger arms 30 directly upward so that the recesses 34 slidably disengage from the ribs 44. The hanger arms 30 and the seat 20 thus can be detached easily and quickly from the frame 10 without the use of tools and without disassembling the swing.

Figure 10:
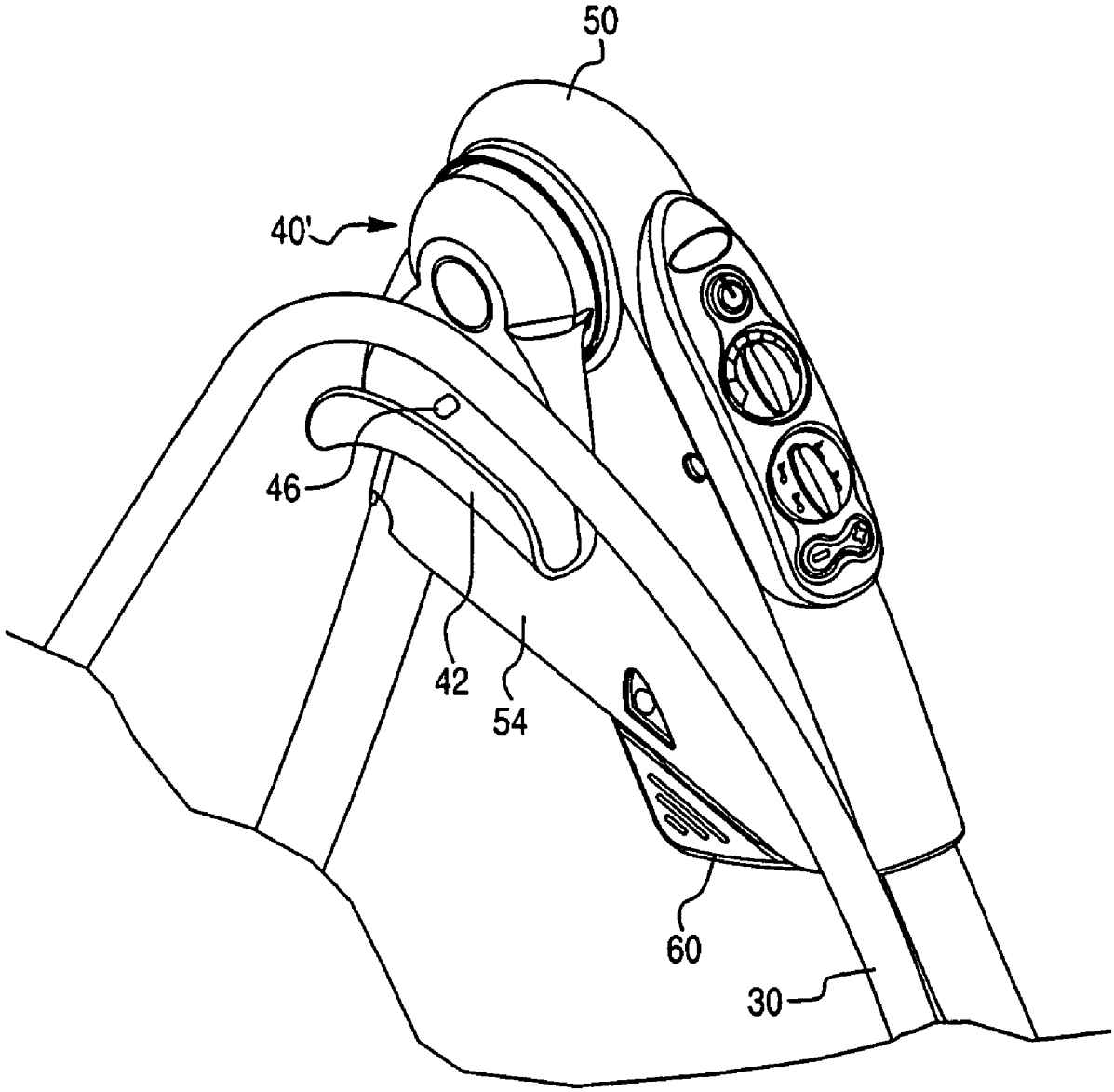
FIG. 10 is a perspective detail view of an alternative hanger mount and shows a hanger arm removed from the hanger mount.

Alternatively, the respective hanger arms can be retained on the respective hanger mounts by detent members. For example, as shown in FIG. 10, each hanger mount 40' can include a detent member 46 biased to project from the hanger mount 40'. The detent member 46 can be disposed on the hanger mount 40' so that, as the user lowers the hanger arm 30 onto the hanger mount 40', the hanger arm 30 pushes the detent member 46 toward the hanger mount 40'. Once the hanger arm 30 is past the detent member 46, the detent member 46 springs back into place to secure the hanger arm 30 to the hanger mount 40'. When the user desires to detach the seat 20 from the frame 10, the user can press the detent member 46 toward the hanger mount 40' so that the hanger arm 30 can be lifted upward past the detent member. In another embodiment of the swing, the detent member can comprise a fixed protuberance on the hanger mount. The hanger arm can be forced past the detent member to snap into place in the hanger mount, and, likewise, it can be forced past the detent member in an opposite direction to detach the hanger arm from the hanger mount. Like the embodiment of FIG. 4, in these embodiments, the hanger arms 30 and the seat 20 can be detached from the frame 10 without the use of tools and without disassembling the swing.

The structural relationship of the hanger arms 30 and the hanger mounts 40, 40' enables a user to easily detach the hanger arms 30 and the seat 20 from the frame 10 without removing the child from the seat 20. Thus, the seat 20 is readily detachable for portability.

The hanger arms 30 can be formed of various materials, such as metal tube or plastic, and can be connected to the seat 20 using conventional hardware. As shown in FIG. 2, one hanger arm 30 can be connected to a first side of the seat 20 and the other hanger arm 30 can be connected to a second side of the seat 20. Additionally, the hanger arms 30 can be connected to the seat 20 in a manner that enables each hanger arm 30 to pivot outward in relation to a side of the seat 20. For example, the hanger arms 30 can be pivotally connected to the seat back 22 at pivots P1 and pivotally connected a seat tray 28 at pivots P2, as shown in FIG. 2. In an alternative embodiment, the hanger arms 30 can be pivotally connected to the seat bottom 24, rather than the seat tray 28. The pivoting connection can be formed using conventional hardware, such as screws or rivets, as shown in FIG. 2.

The pivotal nature of the hanger arms 30 enables the hanger arms to be moved into various positions. For example, the hanger arms 30 can be moved between any of a hanging position, a carrying position, an outrigger position, and a support position.

In the hanging position (shown in FIG. 1), the hanger arms 30 are positioned to engage the frame 10 via the hanger mounts 50 as described above so that the seat 20 is suspended from the frame 10 in a stable manner. When the user activates the motor mechanism, motion is transmitted through the hanger mounts 50 to the hanger arms 30 so that the seat 20 swings back and forth in a forward direction and a rearward direction. Additionally, the open top style of the swing 1 enables the user to install the child in the seat 20, or remove the child from the seat 20, when the seat 20 is suspended from the frame 10.

When the seat 20 is detached from the frame 10, the hanger arms 30 can be moved into the carrying position (shown in FIG. 2). In this regard, a user can detach the seat 20 from the frame 10 without removing the child from the seat 20, move the hanger arms 30 into the carrying position, and transport the child to another location in the seat 20. In the carrying position, a portion of the first hanger arm 30 is disposed adjacent to a portion of the second hanger arm 30 so that the hanger arms 30 form a handle that enables the user to carry the seat 20. A clasp 35 can secure the hanger arms 30 in the carrying position. The clasp 35 can be mounted to one of the hanger arms 30 and can be configured to releasably engage the other hanger arm 30. For example, the clasp 35 can include a collar 39 that encircles one hanger arm 30 and a C-shaped channel 37 configured to snap onto the other hanger arm 30, as shown in the inset view of the clasp 35 in FIG. 2A.

Figure 6:
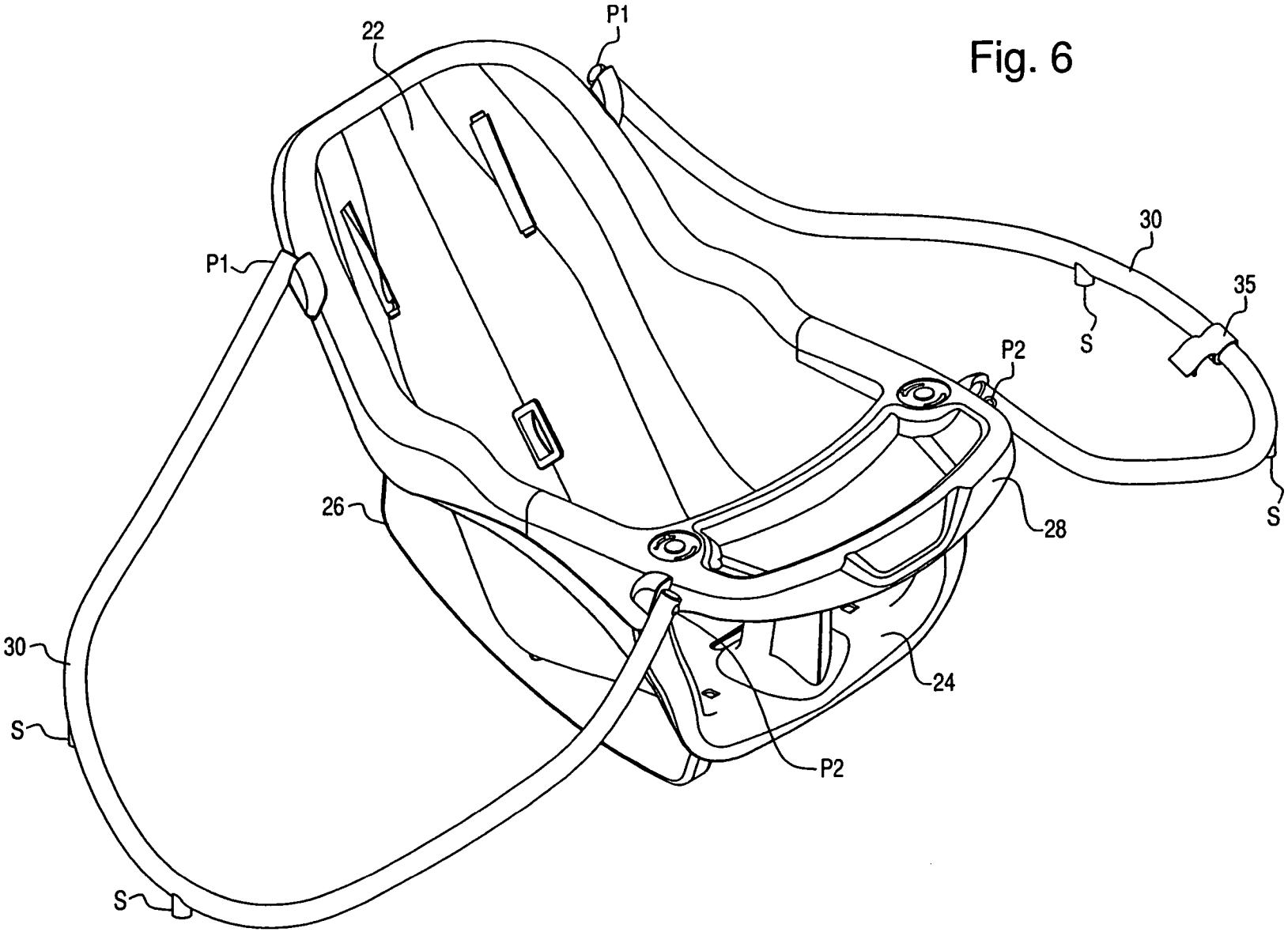
FIG. 6 is a perspective view of the seat and hanger arms of the swing showing the hanger arms in an outrigger position.

Once the seat 20 is detached from the frame 10, the seat 20 can be placed on a support surface as described above. The hanger arms 30 then can be moved into the outrigger position (shown in FIG. 6). In the outrigger position, the hanger arms 30 contact the support surface to prevent the seat 20 from rocking or tipping. For example, as shown in FIG. 6, one hanger arm 30 can project or extend outwardly from a first side of the seat 20, and the other hanger arm 30 can project or extend outwardly from a second side of the seat 20. To further stabilize the seat 20, the hanger arms 30 can be shaped to prevent the seat 20 from rocking. For example, the hanger arms 30 can be shaped so that a substantial portion of each hanger arm 30 contacts the support surface in the outrigger position. In addition, in one embodiment of the swing, each hanger arm 30 can include a substantially straight portion (not shown) to contact the support surface and prevent the seat 20 from rocking. Alternatively, each hanger arm 30 can include stops S (or other structural members) positioned on the hanger arm 30 to contact the support surface and inhibit rocking of the seat 20. In this manner, the hanger arms 30 in the outrigger position stabilize the seat 20, thereby reducing the likelihood that the seat 20 will rock or tip when the seat 20 is placed on the support surface.

According to another aspect of the invention, the hanger arms of the swing can be configured so that, when the seat 20 is detached from the frame 10, the hanger arms optionally can be moved into a support position (shown in FIG. 7). In the support position, the hanger arms are positioned to support the seat 20 on a support surface. For example, the hanger arms can extend between the seat 20 and the support surface so that the underside of the seat 20 is raised above the support surface, as shown in FIG. 7. Further, rather than including a substantially straight portion as described above, the hanger arms 30' can be curved to enable the seat 20 to rock back and forth on the hanger arms 30'. That is, the hanger arms 30' can include a curved portion 36 that contacts the support surface when the hanger arms 30' are in the support position. Thus, in this embodiment, even if the lowermost surface(s) 26' of the seat 20 is flat as shown in FIG. 7, the user can still rock the seat 20 by moving the hanger arms 30' into the support position.

The seat 20 can include at least one pocket (not shown) for storing items, such as bibs, cloths, and small towels. For example, the pocket can be coupled to a rear surface of the seat back 22. Or, in the case of a seat with a reclinable seat back that is pivotally and overlappingly coupled to a seat bottom, the pocket can be formed by the overlapping sections of the seat back and the seat bottom (with the rear surface of the seat back and the upper surface of the seat bottom, where they overlap, forming the walls of the pocket). The pocket can also be positioned at other locations on the seat 20, such as on a side of the seat 20. The pocket can be formed integrally with the seat 20, for example, during a molding process. Alternatively, the pocket can be formed separately from the seat 20 and attached to the seat 20 with conventional hardware. In a further embodiment, the pocket 28 can be formed in a fabric covering that can be disposed on the seat 20 so that the fabric covering covers at least a portion of the seat 20.

Figure 8:
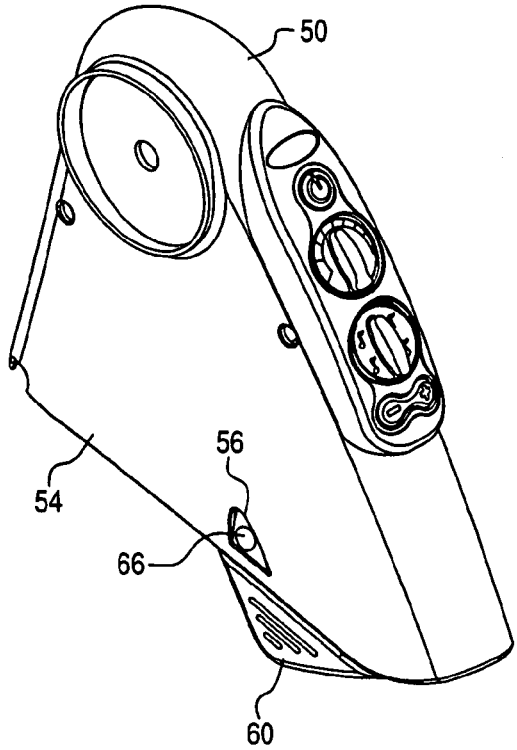
FIG. 8 is a perspective detail view of an embodiment of a swing housing according to the invention with a battery pack installed.
Figure 9:
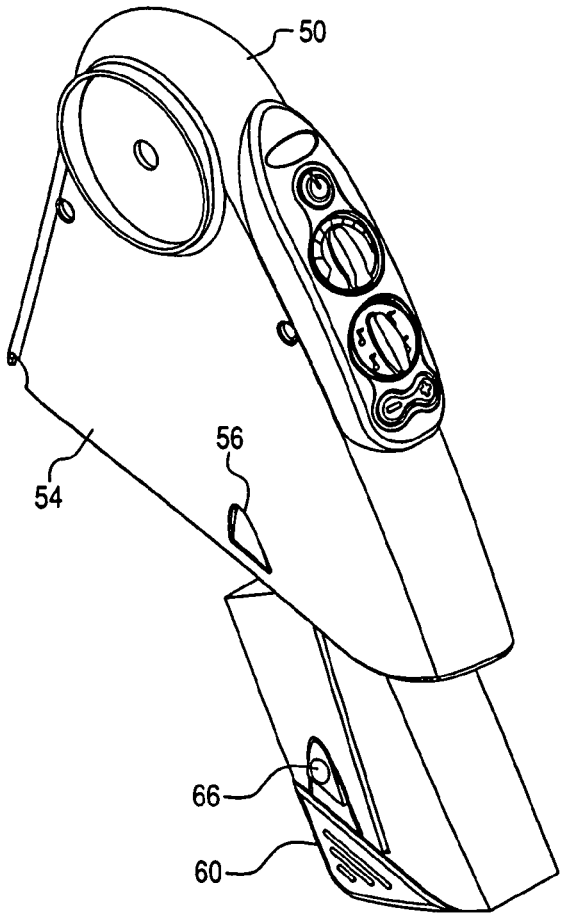
FIG. 9 is a perspective detail view of the swing housing of FIG. 9 with the battery pack removed.

A battery pack 60 can be removably mounted to one of the housings 50 (the right-hand housing in FIG. 1) so that a user can remove the battery pack 60 from the housing 50 without the use of tools and without disassembling the housing 50. For example, the housing 50 can include an outboard side 52 facing outward with respect to the swing 1 and an inboard side 54 facing inward with respect to the swing 1. The inboard side 54 is closer to a centerline of the swing 1 than the outboard side 52. As shown in FIGS. 8 and 9, the housing 50 can include first and second apertures 56 disposed on the outboard and inboard sides 52, 54 of the housing 50, respectively. The battery pack 60 can include flex members 66 for receipt in the apertures 56. For example, the flex members 66 can be disposed on opposite sides of the battery pack 60 so that the flex members 66 protrude from the battery pack 60. The flex members 66 may be, for example, integrally molded with the battery pack 60. As shown in FIG. 8, battery pack 60 can be configured to be inserted into the housing 50 so that the flex members 66 engage the apertures 56. When engaged, the flex members 66 can extend at least partially through the apertures 56. When the flex members 66 and the apertures 56 are engaged, the battery pack 60 is retained in the housing 50. As shown in FIG. 9, the battery pack 60 can be removed from the housing 50. For example, the user can remove the battery pack 60 by pressing the flex members 66 toward the housing 50 so that the flex members 66 clear the apertures 56, thereby disengaging from the apertures 56. When the flex members 66 and the apertures 56 disengage, the battery pack 60 can be easily pulled out of the housing 60. In this manner, the user can easily remove the battery pack 60 for battery recharging or replacement.

The embodiments described above have been set forth herein for the purpose of illustration. This description, however, should not be deemed to be a limitation on the scope of the invention. Various modifications, adaptations, and alternatives may occur to one skilled in the art without departing from the claimed inventive concept. The scope and spirit of the invention are indicated by the following claims.

What is claimed is:

1. An infant swing comprising:

a frame assembly with a front, a rear, and first and second sides;

a seat assembly removably suspended between the first and second sides for swinging between the front and the rear of the frame assembly;

a handle assembly coupled to the seat assembly and having first and second hanger arms, one on each side of the seat assembly, configured and positionable to rest on a part of the frame assembly to suspend the seat assembly from the frame assembly, the seat assembly arranged to be lifted upward from the frame assembly when removed; and a motor carried on the frame assembly and capable of swinging the seat assembly when suspended from the frame assembly, wherein the frame assembly is open above the seat assembly with no part of the frame assembly traversing between the first and second sides above the seat assembly and wherein each of the first and second hanger arms is generally C-shaped, oriented in a downward open position, and has front and rear ends pivotally coupled to a respective front end and a rear end of the seat assembly.

2. An infant swing according to claim 1, wherein the seat assembly includes a bottom surface configured to permit resting the seat assembly on a surface for use as a seat independent of the frame assembly.

3. An infant swing according to claim 1, wherein the seat assembly is suspended from a pair of mounts, one positioned on each of the first and second sides of the frame assembly, each mount having an upwardly facing open channel.

4. An infant swing according to claim 3, wherein the first and second hanger arms are configured to rest in the open channel of one of the mounts.

5. An infant swing comprising:

a frame assembly with a front, a rear, and first and second sides;

a seat assembly removably suspended between the first and second sides for swinging between the front and the rear of the frame assembly;

a handle assembly coupled to the seat assembly and having first and second hanger arms, one on each side of the seat assembly, configured and positionable to rest on a part of the frame assembly to suspend the seat assembly from the frame assembly, the seat assembly arranged to be lifted upward from the frame assembly when removed; and a motor carried on the frame assembly and capable of swinging the seat assembly when suspended from the frame assembly, wherein the frame assembly is open above the seat assembly with no part of the frame assembly traversing between the first and second sides above the seat assembly and wherein each of the hanger arms can be pivoted toward one another above the seat assembly to form a single handle configured for gripping by one hand of a user.

6. An infant swing according to claim 5, wherein the seat assembly includes a bottom surface configured to permit resting the seat assembly on a surface for use as a seat independent of the frame assembly.

7. An infant swing according to claim 5, wherein the seat assembly is suspended from a pair of mounts, one positioned on each of the first and second sides of the frame assembly, each mount having an upwardly facing open channel.

8. An infant swing according to claim 7, wherein the first and second hanger arms are configured to rest in the open channel of one of the mounts.

9. An infant swing comprising:

a frame assembly with a front, a rear, and first and second sides;

a seat assembly removably suspended between the first and second sides for swinging between the front and the rear of the frame assembly about a swing axis, first and second mounts, one positioned on each of the first and second sides of the frame assembly, coupled to the frame assembly to rotate about the swing axis, first and second hanger arms each having a first end connected to one side of the seat assembly and a second end, the first and second mounts each having a channel to receive the second end of the first and second hanger arms, respectively, at a location below the swing axis to suspend the seat assembly from the frame assembly, the mounts being configured so that the first and second hanger arms can be lifted up and out of the channels to remove the seat assembly from the frame assembly, and a motor carried on the frame assembly and capable of swinging the seat assembly when suspended from the frame assembly, wherein the frame assembly is open above the seat assembly with no part of the frame assembly traversing between the first and second sides above the seat assembly.

* * * * *